US007320305B2

(12) United States Patent
Alberghini et al.

(10) Patent No.: US 7,320,305 B2
(45) Date of Patent: Jan. 22, 2008

(54) REGULATING DEVICE FOR REGULATING THE AIR INTAKE OF A VEHICLE INTERNAL COMBUSTION ENGINE

(75) Inventors: Mirco Alberghini, Renazzo (IT); Maurizio Fiorentini, Molinella (IT); Claudio Grossi, Quarto Inferiore (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 11/541,257

(22) Filed: Sep. 29, 2006

(65) Prior Publication Data

US 2007/0079806 A1 Apr. 12, 2007

(30) Foreign Application Priority Data

Mar. 10, 2005 (EP) ..... 05425685

(51) Int. Cl.
*F02D 1/00* (2006.01)
*F02M 1/00* (2006.01)

(52) U.S. Cl. ..... 123/336; 123/442

(58) Field of Classification Search ..... 123/336, 123/399, 403, 442, 478, 198 DB; 180/197
See application file for complete search history.

(56) References Cited

U.S. PATENT DOCUMENTS 4,637,487 A 1/1987 Nakamura et al.
4,811,808 A 3/1989 Matsumoto et al.
4,995,364 A 2/1991 Kamei et al.
5,157,956 A * 10/1992 Isaji et al. ..... 73/1.75
5,224,044 A * 6/1993 Tamura et al. ..... 701/91
5,415,142 A * 5/1995 Tsubakiji et al. ..... 123/336
5,520,146 A 5/1996 Hrovat et al.
5,566,776 A * 10/1996 Iwata ..... 180/197

FOREIGN PATENT DOCUMENTS

EP 0089492 9/1983
EP 0659991 6/1995

* cited by examiner

*Primary Examiner*—John T. Kwon
(74) *Attorney, Agent, or Firm*—Gottlieb, Rackman & Reisman

(57) ABSTRACT

A regulating device for regulating the air intake of an internal combustion engine, and comprising at least one throttled body having at least one air feed conduit connectable to the engine, and a first and second throttle housed in said at least one feed conduit to regulate air intake of the engine on command; the regulating device comprises a manually operated accelerator control device connected mechanically to the first throttle to rotate the first throttle about a first axis of rotation into an operating angular position related to the engine torque demanded by the user operating the accelerator control device; and electric control means for rotating the second throttle about a second axis of rotation into a target angular position determined as a function of the operating angular position of the first throttle.

7 Claims, 2 Drawing Sheets

REGULATING DEVICE FOR REGULATING THE AIR INTAKE OF A VEHICLE INTERNAL COMBUSTION ENGINE

The present invention relates to a regulating device for regulating the air intake of an internal combustion engine.

The present invention may be used to particular advantage, though not exclusively, in motor vehicles or motorcycles, to which the following description refers purely by way of example.

BACKGROUND OF THE INVENTION

As is known, certain last-generation vehicles are equipped with a regulating device for fully automatically controlling air intake of the engine as a function of a number of vehicle/engine parameters supplied by respective sensors, and on the basis of the position of the accelerator control device (pedal or grip) set by the user.

The regulating device substantially comprises a throttled body connected to the engine and having a feed conduit along which the air intake by the engine flows; and a throttle housed inside the feed conduit and which rotates, on command, about an axis of rotation to regulate the air intake of the engine and so adjust the torque generated by the engine.

In the case in question, the throttle rotates about its axis between two limit positions corresponding to minimum and maximum air flow respectively.

The regulating device also comprises an electric actuator for rotating the throttle; a potentiometer connected to the throttle to determine its angular position; and an electronic central control unit which, depending on torque demand by the user and on the operating condition of the vehicle/engine, calculates a target angular position of the throttle and accordingly controls the electric actuator to set the throttle to the calculated target angular position.

A major drawback of the above regulating device is that any malfunctioning of the sensors and/or electronic components cooperating actively with the electronic central control unit to control the throttle impairs the precision with which the throttle position is controlled, and may create a certain amount of unease in the user when the throttle remains in a position allowing the engine to generate a higher torque than demanded by the user.

In which case, in fact, any attempt by the user to release the accelerator pedal (grip) to reduce air flow to the engine fails to produce a corresponding rotation of the throttle. In other words, in the event of electric throttle control failure, the user is unable to reduce the engine torque.

To eliminate the above drawback, it has been proposed to increase the number of vehicle and/or engine parameter measurements to achieve redundant data processing by which to safely control operation of the throttle. Besides complicating processing by the electronic central control unit, however, this solution calls for a large number of sensors, thus increasing the manufacturing cost of the regulating device.

EP-0089492 discloses an internal combustion engine for vehicle having at one cylinder, an intake manifold leading to cylinders, a fuel supply means, an accelerator, a first throttle provided in the intake manifold.

U.S. Pat. No. 4,637,487 discloses a traction control device in an engine which has an intake passage. The throttle valve and a flow control valve are arranged in series in the intake passage EP-0659991 discloses an system for controlling the flow of air entering the intake manifold of a multi cylinder variable displacement internal combustion engine installed in a vehicle having a driver-operable accelerator control includes an accelerator control position sensor for determining the operating position of the accelerator control and for generating an accelerator control position signal indicating such position, as well as an engine speed sensor for determining the speed of the engine and for generating an engine speed signal indicating such speed.

U.S. Pat. No. 5,520,146 discloses an electronic controller for automatically adjusting the position of a throttle valve in either a signal valve or a series valve throttle mechanism.

SUMMARY OF THE INVENTION

It is an object of the present invention to provide a regulating device for regulating the air intake of a vehicle internal combustion engine, which is cheap to produce and, at the same time, ensures a reduction in air flow when the accelerator control device is in the partly or fully released position.

According to the present invention, there is provided a regulating device for regulating the air intake of a vehicle internal combustion engine, as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
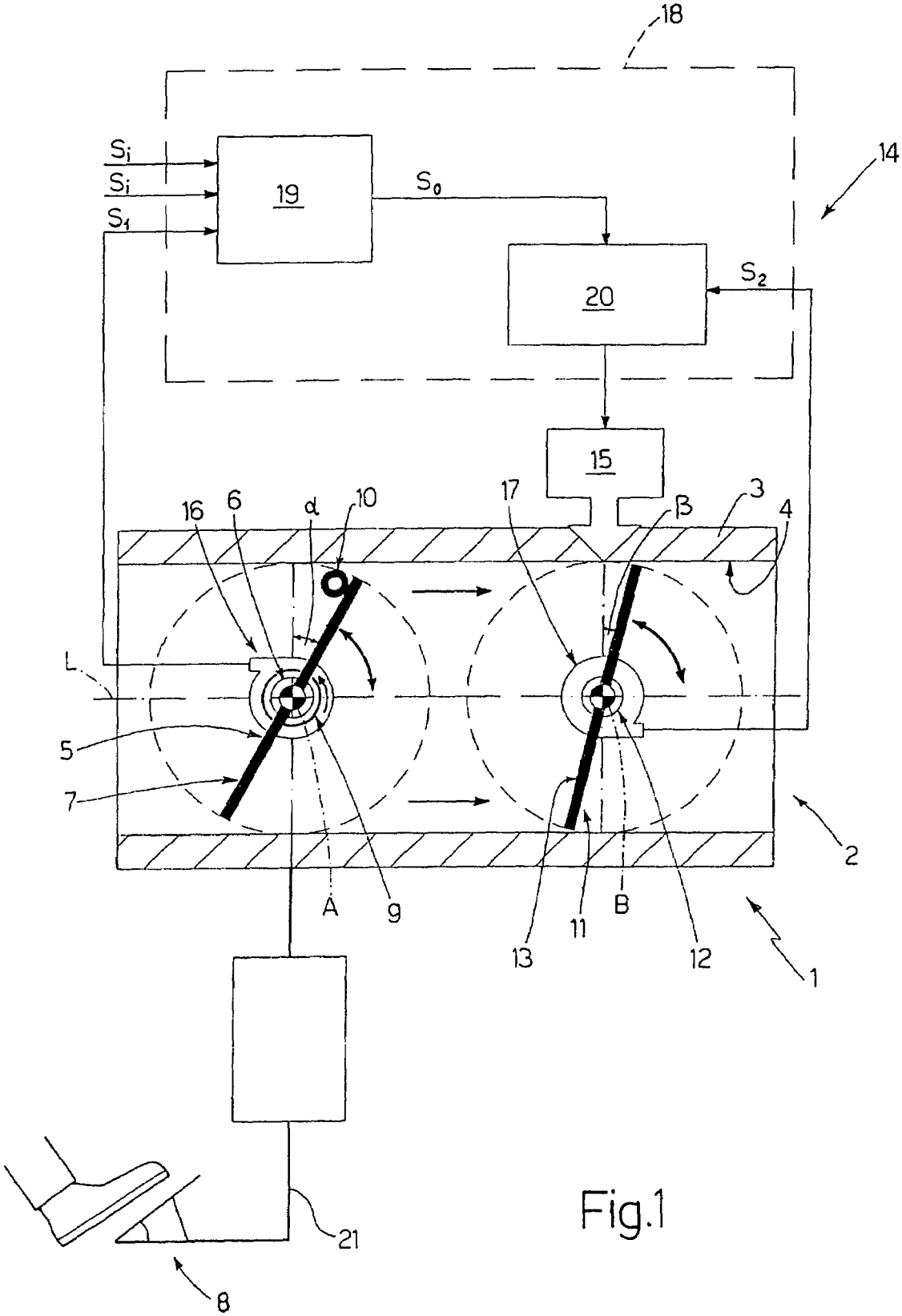
FIG. 1 shows, schematically, a regulating device for regulating the air intake of a vehicle internal combustion engine.

Number 1 in FIG. 1 indicates as a whole a regulating device for regulating the air intake of an internal combustion engine (not shown) of a vehicle (not shown), to adjust the torque generated by the engine.

Regulating device 1 substantially comprises at least one throttled body 2, in turn comprising an outer casing 3 having at least one feed conduit 4 connectable to the engine to supply the engine with air; and two throttles housed inside feed conduit 4 to appropriately regulate air intake of the engine (as described below).

More specifically, the two throttles are located one after the other inside feed conduit 4, and rotate on command about respective axes of rotation A and B, which are preferably, though not necessarily, parallel to each other and perpendicular to the longitudinal axis L of feed conduit 4.

As described in detail below, one of the two throttles is rotated about axis A by a mechanical accelerator control device operated manually by the user to demand a given torque of the engine, while the other throttle is rotated about axis B by an electric control device employing an electronic control, which controls rotation of the relative throttle on the basis of the angular position of the "mechanically controlled" throttle, and preferably, though not necessarily, as a function of vehicle/engine operating conditions.

With reference to FIG. 1, the mechanically operated throttle—hereinafter referred to as throttle 5—is preferably, though not necessarily, located upstream from the other throttle in the air flow direction (indicated by the arrows in FIG. 1), and has a pin 6 mounted to rotate about axis A inside feed conduit 4, and a shutter plate 7 for reducing air flow along feed conduit 4 as a function of its angular position.

More specifically, plate 7 is fixed firmly to pin 6, and rotates about axis A to and from an angular rest position (FIG. 1), in which plate 7 is coplanar with a plane coaxial with axis A which is tilted at an angle $\alpha$ with respect to a plane perpendicular to longitudinal axis L of feed conduit 4.

As described in detail below, the "open" angle $\alpha$ of plate 7 of throttle 5 in the angular rest position is sized to allow sufficient air flow along feed conduit 4 to "cold start" the engine.

In the FIG. 1 example, throttle 5 is connected over an accelerator cable 21 to a mechanical accelerator control device 8, e.g. an accelerator pedal (shown schematically) (or a grip), which is user-operated manually to mechanically control rotation of throttle 5, about axis A, between the angular rest position and a given open operating position.

More specifically, when accelerator control device 8 is in a release position (obtained, for example, by the user releasing the accelerator pedal), throttle 5 moves into the angular rest position, whereas operation of accelerator control device 8 (e.g. by pressing the accelerator pedal) rotates throttle 5 accordingly into an open operating angular position (not shown). In the example shown, accelerator control device 8 converts the torque demand by the user to a corresponding operating angular position of throttle 5.

It should be pointed out that, in the example shown, throttle 5 has an elastic member defined, for example, by a spring 9, which is fitted to throttle 5 to restore it to the rest position when direct manual user operation of accelerator control device 8 ceases (when the accelerator pedal is released). For this purpose, throttle 5 may preferably be provided with a stop member 10 which, upon user release of accelerator control device 8, arrests rotation of throttle 5, produced by the elastic thrust of spring 9, in the relative angular rest position. In the example shown, stop member 10 may preferably, though not necessarily, be defined by a mechanical stop portion connected firmly to outer casing 3, and onto which throttle 5 is rotated by spring 9.

The "electrically controlled" throttle—hereinafter referred to as throttle 11—is preferably, though not necessarily, located downstream from throttle 5 in the air flow direction (indicated by the arrows in FIG. 1), and has a pin 12 mounted to rotate about axis B inside feed conduit 4, and a shutter plate 13 for reducing air flow along feed conduit 4 as a function of its angular position.

More specifically, plate 13 is fixed firmly to pin 12, and rotates about axis B to and from a minimum open angular position (FIG. 1), in which plate 13 of throttle 11 is coplanar with a plane coaxial with axis B and tilted at an angle $\beta$ with respect to a plane perpendicular to longitudinal axis L of feed conduit 4.

As described in detail below, the "minimum open" angle $\beta$ of throttle 11 in the minimum open position is sized to allow sufficient minimum air flow along feed conduit 4 to control engine speed in given engine/vehicle operating conditions.

In connection with the above, it should be pointed out that open angle $\beta$ of throttle 11 in the minimum open angular position is preferably smaller than open angle $\alpha$ of mechanically controlled throttle 5 in the angular rest position.

In the FIG. 1 example, throttle 11 is controlled by an electric control device 14 comprising an electric drive 15; two measuring devices 16, 17 for supplying the angular positions of plates 7, 13 of throttles 5, 11; and an electronic central control unit 18 for controlling the angular position of plate 13 of throttle 11 instant by instant.

More specifically, electric drive 15 (shown schematically in FIG. 1) may be defined by an electric actuator, or an electric motor, or any other similar electric actuating device connectable to throttle 11 to rotate it to and from the minimum open angular position; and measuring devices 16, 17 may be defined by two potentiometers fitted to pins 6, 12 of throttles 5, 11 to supply a first and second signal $S_1$, $S_2$ indicating the angular positions of throttles 5, 11.

Electronic central control unit 18 provides for controlling electric drive 15 to control rotation of throttle 11. In the FIG. 1 example, electronic central control unit 18 comprises a computing module 19, which receives signal $S_1$ indicating the angular position of plate 7 of throttle 5, receives a number of signals $S_i$ coding engine/vehicle operating parameters, and supplies a signal $S_o$ indicating the target angular position of throttle 11.

In the example shown, computing module 19 processes the angular position of throttle 5 to determine the user-demanded engine torque, and, on the basis of this and the engine/vehicle operating parameters, calculates the best torque to be generated by the engine. Once the best torque is determined, computing module 19 calculates the corresponding target angular position to which to set throttle 11.

Electronic central control unit 18 also comprises a control module 20, which receives signal $S_o$ indicating the target position, receives signal $S_2$ coding the angular position of throttle 11, and, by processing these parameters, controls electric drive 15 to rotate plate 13 of throttle 11 into the calculated target angular position.

Regulating device 1 operates as follows. The user demands a given engine torque by operating accelerator control device 8, e.g. by pressing the accelerator pedal, which accordingly rotates throttle 5 into an operating angular position related to the engine torque demanded by the user.

At this stage, measuring device 16 supplies electronic central control unit 18 with signal $S_1$ coding the measured angular position, and computing module 19 calculates the target angular position of throttle 11 as a function of the vehicle/engine operating parameters and the operating angular position of throttle 5, which, as stated, is related to the user torque demand. At this point, control module 20 activates electric actuator 15 to rotate throttle 11 to the target angular position calculated by computing module 19.

In connection with the above, it should be pointed out that the sizing described of angles $\alpha$ and $\beta$, corresponding to the angular rest position of plate 7 and the minimum open angular position of plate 13 respectively, has the big advantage, on the one hand, of allowing the user to cold-start the engine, and, on the other, of allowing electronic central control unit 18 to control start-up and idling of the engine by controlling rotation of throttle 11 in any ambient condition.

More specifically, when starting up the engine, throttle 5, being set to the rest angular position, allows sufficient air flow for any start-up temperature, and so has no effect whatsoever on engine air intake adjustment, which is controlled directly by throttle 11 on the basis of the commands generated by electronic central control unit 18.

In connection with the above, it should also be pointed out that manually operated accelerator control device 8 mechanically controls rotation of first throttle 5 to allow the user to directly reduce air intake of the engine, in the event of a malfunction in electronic control of the angular position of second throttle 11, such as the opening of second throttle 11 nor corresponding to the user torque demand, or second throttle 11 jamming in a given open angular position, or any other malfunction of second throttle 11 not corresponding to control by the user.

Regulating device 1 as described above has several advantages. In particular, any uncertainty arising from a potential malfunction in electronic control of throttle 11 is eliminated. That is, mechanically controlled throttle 5, operated directly by the user, allows the user to directly reduce engine torque in the event of failure to electronically control throttle 11. In other words, manually operated accelerator control device 8 rotates throttle 5 to allow the user to directly reduce air intake of the engine in the event of any malfunctioning in electronic control of the angular position of throttle 11 by electronic central control unit 18. When the user releases accelerator control device 8, in fact, spring 9 restores throttle 5 to the rest position, thus reducing engine torque.

Moreover, as pointed out above, the difference in the open angles $\alpha$ and $\beta$ of throttles 5 and 11 in their respective angular positions permits optimum start-up and idling control of the engine in any ambient condition.

Clearly, changes may be made to the regulating device as described and illustrated herein without, however, departing from the scope of the present invention as defined in the accompanying Claims.

Figure 2:
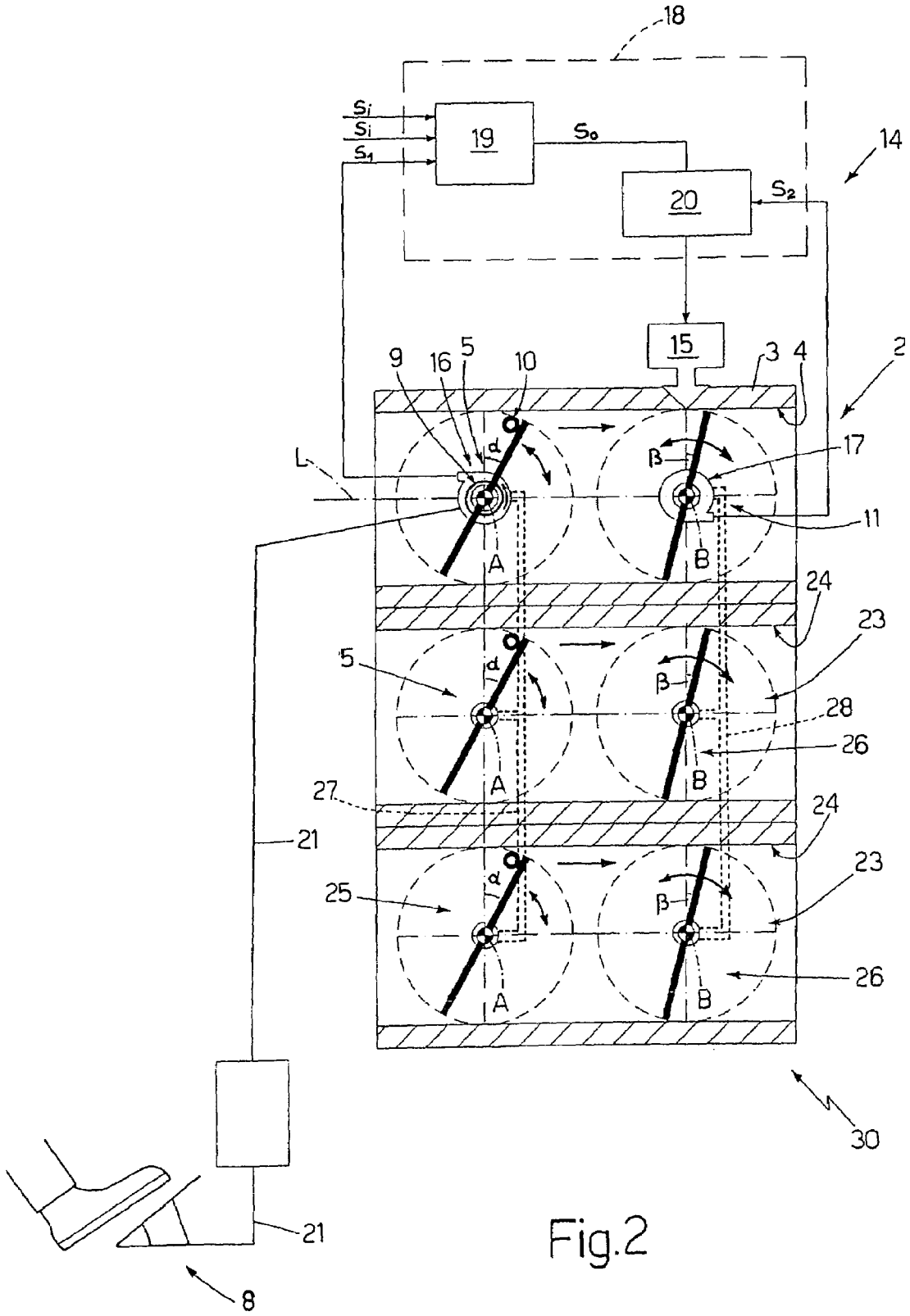
FIG. 2 shows a variation of the FIG. 1 regulating device.

The FIG. 2 embodiment relates to a regulating device 30 similar to regulating device 1, and the component parts of which are indicated, where possible, using the same reference numbers as for the corresponding parts of regulating device 1.

In addition to throttled body 2 described above, regulating device 30 also comprises a number of throttled bodies 23, each comprising a feed conduit 24 housing a throttle 25 of the same mechanical structure as throttle 5, and a throttle 26 of the same mechanical structure as throttle 11 described above.

More specifically, regulating device 30 comprises a mechanical transmission 27 (shown schematically by the dash line) comprising, for example, a number of shafts or articulated arms, which connect throttles 25 to throttle 5, so that mechanical rotation of throttle 5, by the user operating accelerator control device 8, produces the same angular rotation of throttles 25.

Regulating device 30 also comprises a mechanical transmission 28 (shown schematically by the dash line) comprising, for example, a number of shafts or articulated arms, which connect throttles 26 to throttle 11, so that electric rotation of throttle 11 by electric control device 14 produces the same angular rotation of throttles 26.

It should be pointed out that, when the accelerator is not operated, throttles 25 are set to the same rest angular position (angle $\alpha$) as throttle 5; and throttles 26 are maintained at all times in the same angular position as throttle 11, and move off from the same minimum open position (angle $\beta$) as throttle 11.

In an alternative embodiment not shown, regulating device 30 comprises a single throttled body 2 comprising a number of feed conduits 24, each housing a throttle 25 of the same mechanical structure as throttle 5, and a throttle 26 of the same mechanical structure as throttle 11 described above.

As in the FIG. 2 embodiment, throttles 25 are connected mechanically to throttle 5 by a mechanical system which transmits rotation of throttle 5 to throttles 25; and throttles 26 are connected mechanically to throttle 11 by a mechanical system which transmits rotation of throttle 11 to throttles 26, so that operation is identical to that of the FIG. 2 embodiment.

The invention claimed is:

1. A regulating device for regulating the air intake of an internal combustion engine, the regulating device comprising at least one throttled body having at least one air feed conduit connectable to the engine; and a first and second throttle housed in said at least one feed conduit to regulate air intake of the engine on command, feed conduit defining a longitudinal axis; the regulating device further including a manually operated accelerator control device connected mechanically to the first throttle to rotate the first throttle about a first axis of rotation into an operating angular position related to the engine torque demanded by the user operating the accelerator control device; and electric control means for rotating the second throttle about a second axis of rotation into a target angular position determined as a function of the operating angular position of the first throttle;

wherein the manually operated accelerator control device rotates the first throttle to and from a predetermined first angular rest position, in which the first throttle permits a sufficient air flow to start up said engine in a predetermined minimum engine temperature condition;

wherein said electric control means controls rotation of said second throttle to and from a predetermined second minimum open angular position, in which the second throttle permits a predetermined minimum air flow allowing operation of the engine in a predetermined engine operating condition;

wherein in said first angular position, the first throttle lies in a plane sloping at a first angle with respect to a plane perpendicular to the longitudinal axis of the feed conduit; and wherein, in said second angular position, the second throttle lies in a plane sloping at a second angle with respect to a plane perpendicular to the longitudinal axis of the feed conduit; said first angle being greater than said second angle.

2. A regulating device as claimed in claim 1, wherein said electric control means comprises first and second measuring means for measuring the angular position of said first and said second throttle respectively; and electric actuating means for controlling rotation of said second throttle.

3. A regulating device as claimed in claim 2, wherein said electric control means comprises an electronic central control unit having computing means receiving the angular position of said first throttle and at least one engine/vehicle operating parameter; said computing means calculating the target angular position of the second throttle as a function of the angular position of the first throttle and as a function of said at least one engine/vehicle operating parameter.

4. A regulating device as claimed in claim 3, wherein said electronic central control unit comprises control means for controlling said electric actuating means as a function of the target angular position calculated by the computing means, and on the basis of the angular position of said second throttle, so as to rotate the second throttle to said target angular position.

5. A regulating device as claimed in claim 1, further including a plurality of throttled bodies, each throttled body comprising at least one air feed conduit housing a first and second throttle; the manually operated accelerator control device being connected mechanically to said first throttles to rotate them about respective first axes of rotation into the same operating angular position related to the engine torque demand by the user; and wherein said electric control means controls rotation of said second throttles about respective second axes of rotation into the same target angular position calculated as a function of the operating angular position of the first throttles.

6. A regulating device as claimed in claim 1, wherein said at least one throttled body comprises a number of feed conduits, each housing the first and second throttle; the manually operated accelerator control device being connected mechanically to said first throttles to rotate them about respective first axes of rotation into the same operating angular position related to the engine torque demand by the user; and wherein said electric control means controls rotation of said second throttles about respective second axes of rotation into the same target angular position calculated as a function of the operating angular position of the first throttles.

7. A regulating device as claimed in claim 1, wherein said manually operated accelerator control device rotates the first throttle to allow the user to directly reduce air intake of the engine in the event of failure to electronically control the angular position of the second throttle.

* * * * *

UNITED STATES PATENT AND TRADEMARK OFFICE

CERTIFICATE OF CORRECTION

PATENT NO. : 7,320,305 B2
APPLICATION NO. : 11/541257
DATED : January 22, 2008
INVENTOR(S) : Mirco Alberghini et al.

It is certified that error appears in the above-identified patent and that said Letters Patent is hereby corrected as shown below:

Title page, item (30) Foreign Application Priority Data

Change "Mar. 10, 2005" to -- October 3, 2005 --

Signed and Sealed this

Second Day of December, 2008

JON W. DUDAS
*Director of the United States Patent and Trademark Office*